US006195518B1

(12) United States Patent
Bennett et al.

(10) Patent No.: US 6,195,518 B1
(45) Date of Patent: Feb. 27, 2001

(54) WEB CROSS-TRACK FORCE MONITORING MECHANISM

(76) Inventors: Charles John Bennett, Xerox Corporation 800 Philips Rd., Webster, NY (US) 14425; Larry Thomas Schlitzer, 901 Elmgrove Rd.-Bldg. 11, Rochester, NY (US) 14653-6029

( * ) Notice: Subject to any disclaimer, the term of this patent is extended or adjusted under 35 U.S.C. 154(b) by 0 days.

(21) Appl. No.: 09/443,603

(22) Filed: Nov. 19, 1999

(51) Int. Cl.[7] ..... G03G 21/00
(52) U.S. Cl. ..... 399/165; 198/810.03
(58) Field of Search ..... 399/165, 329; 198/806, 807, 810.03; 226/18, 19, 21

(56) References Cited

U.S. PATENT DOCUMENTS

| | | | | |
|---|---|---|---|---|
| 4,429,985 | * | 2/1984 | Yokota . | |
| 5,510,877 | * | 4/1996 | deJong et al. . | |
| 5,717,984 | * | 2/1998 | Wong | 399/165 |
| 5,896,158 | * | 4/1999 | Brenner et al. | 347/116 |
| 5,903,805 | * | 5/1999 | Ueda et al. | 399/165 |
| 5,978,003 | * | 11/1999 | Brenner | 347/116 |

* cited by examiner

*Primary Examiner*—Richard Moses
(74) *Attorney, Agent, or Firm*—Lawrence P. Kessler

(57) ABSTRACT

A web-tracking control apparatus including a mechanism for monitoring the cross-track force exerted on a moving flexible web as the web is transported along a desired travel path, and a control circuit utilizing the monitored force to provide for feedback control to correct tracking of the moving web. The web-tracking control apparatus for controlling the movement of a flexible web traveling about an adjustable support member includes at least one web edge contacting member contacting a marginal edge of the flexible web. A pivot assembly is operatively associated with the web edge contacting member while said web edge contacting member is in contact with a marginal edge of said flexible web. The pivot assembly is capable of deflecting a predetermined amount proportional to the force of the flexible web on the edge contacting member. A cross-track force monitoring mechanism is operatively associated with the pivot assembly for producing a signal representative of deflection of the pivot assembly. An electronic circuit responsive to the pivot assembly deflection signal provides a correction signal for causing adjustment of the position of the web support member so that the web support supports the flexible web for movement without any substantially cross-track force being exerted on the web edge contacting member.

12 Claims, 5 Drawing Sheets

WEB CROSS-TRACK FORCE MONITORING MECHANISM

FIELD OF THE INVENTION

This invention relates in general to tracking of an elongated flexible web, and more particularly to a mechanism for monitoring the cross-track force exerted on a flexible web and using the monitored force for feedback to correct tracking of the web.

BACKGROUND OF THE INVENTION

Transport of an elongated flexible web along a desired travel path is accomplished, for example, by supporting the web at various locations with rollers or support shoes. With an ideal web, perfectly straight support shoes or rollers, and accurate support mounting and alignment with respect to the web and to each other, the web will track in the direction about the desired travel path about the supports without lateral deviation. However, in practice, such ideal conditions rarely, if ever, exist. As such as the web is transported in the desired travel path, the web additionally tends to track laterally relative to the intended path.

In certain electrographic reproduction apparatus, dielectric members are utilized in the form of elongated flexible webs transported along a desired travel path about a series of support shoes and rollers. An edge guide assembly is provided to control lateral deviation of the dielectric member web with respect to the support shoes and rollers as the web is transported in the desired travel path. Due to the fragile nature of the web, problems occur when the force of a side guide member of the edge guide assembly, acting on the edge of a transported web, exceeds the beam strength of the web. That is to say, internal or external forces act on the web to generate movement in the plane of a web in the direction lateral to movement of the web along the desired travel path. The web propagates in that direction until it meets a resistance, such as that established by a side guide member of the edge guide assembly. Since the edge guide assembly is basically fixed in location, a resultant counter force is established on the web in the plane of the web. If this force increases beyond the end-loaded beam strength of the web, the web will buckle or otherwise become undesirably distorted. Ultimately, the web may curl on itself or tear, resulting in a tracking failure and/or a hard reproduction apparatus shutdown in order to provide for service or replacement of the web.

Web-tracking systems in high volume, web based, electrographic reproduction apparatus typically utilize non-constraining roller tracking systems, such as a number of castered and/or gimbaled roller mechanisms and an edge guide assembly. The castered and gimbaled roller mechanisms react to changes in web-tracking due to variability of external loads, and minimize the relative forces exerted on the web by the side guide members of the edge guide assemblies. External loads may include receiver member feed or registration mechanisms, cleaning brushes and blades, or roller chargers. Further, external loads may vary due to variations in physical characteristics from one web to another. Web-tracking may be effected over time due to changes in the external loads, or due to differences between replacement webs. The relative force induced in the web by the edge guide assembly on the web edge is very difficult to measure. Moreover, such force is not maintained within a particular predetermined tolerance range, premature damage to the web may result.

SUMMARY OF THE INVENTION

In view of the above, this invention is directed to a web-tracking control apparatus including a mechanism for monitoring the cross-track force exerted on a moving flexible web as the web is transported along a desired travel path, and a control circuit utilizing the monitored force to provide for feedback control to correct tracking of the moving web. The web-tracking control apparatus for controlling the movement of a flexible web traveling about an adjustable support member includes at least one web edge contacting member contacting a marginal edge of the flexible web. A pivot assembly is operatively associated with the web edge contacting member while said web edge contacting member is in contact with a marginal edge of said flexible web. The pivot assembly is capable of deflecting a predetermined amount proportional to the force of the flexible web on the edge-contacting member. A cross-track force monitoring mechanism is operatively associated with the pivot assembly for producing a signal representative of deflection of the pivot assembly. An electronic circuit responsive to the pivot assembly deflection signal provides a correction signal for causing adjustment of the position of the web support member so that the web support supports the flexible web for movement without any substantially cross-track force being exerted on the web edge contacting member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
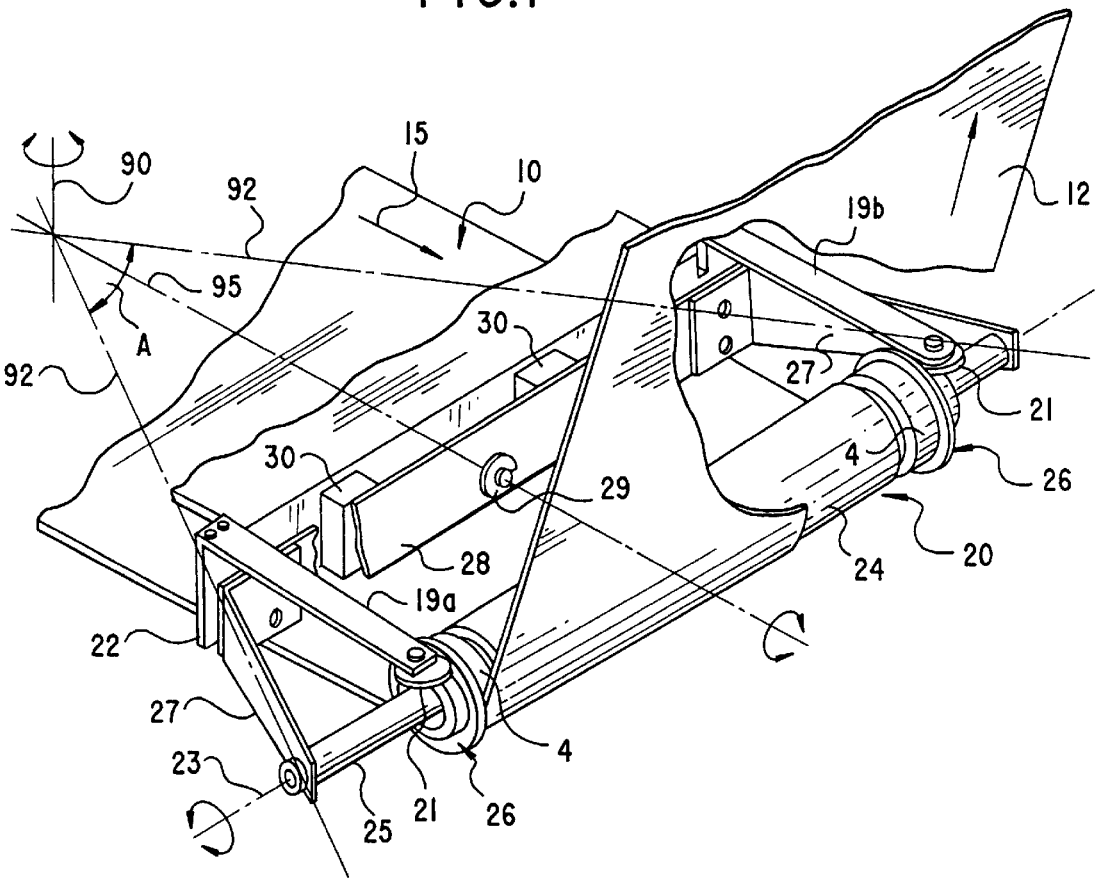
FIG. 1 is a view, in perspective, of a passive laterally constraining web support showing the relative location of various web constraining control axes, and the direction of movement of the web, with portions in cross-section or broken away to facilitate viewing.
Figure 2:
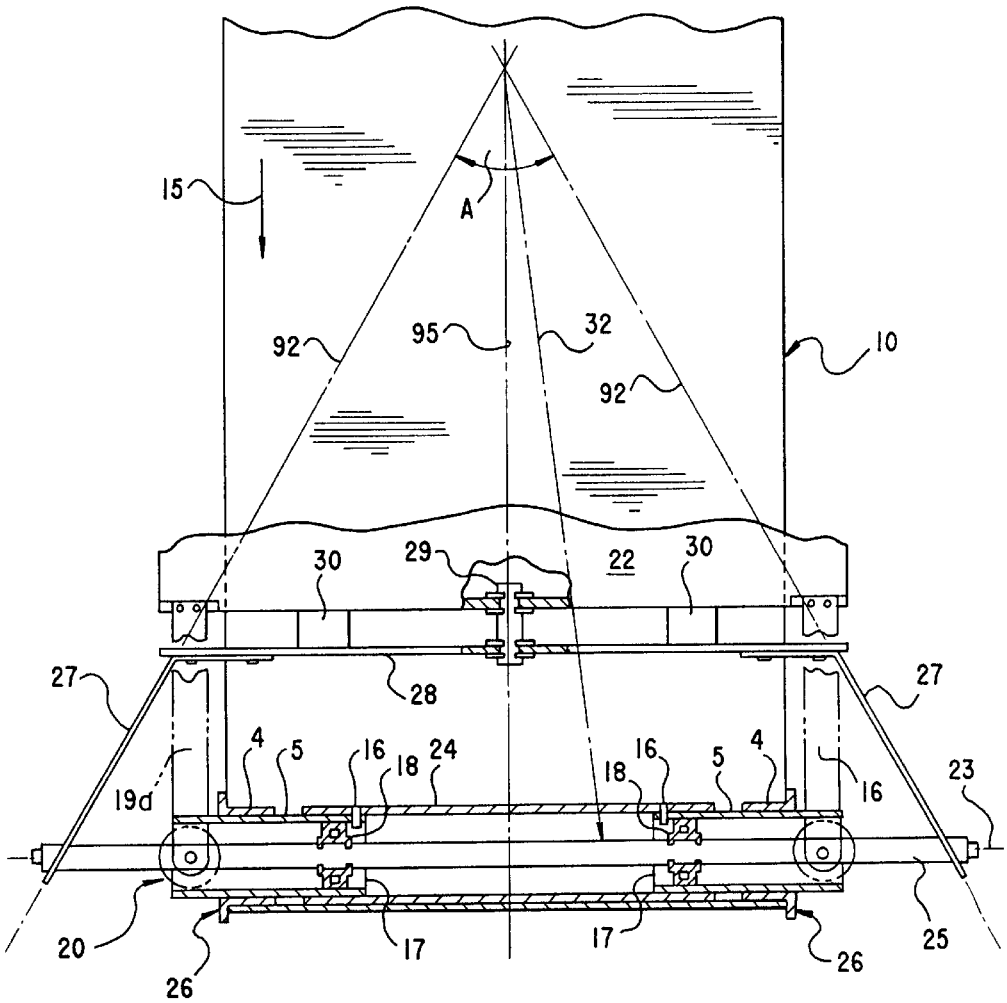
FIG. 2 is a top plan view of the web support of FIG. 1, showing the roller support and web edge engaging portions in cross-section.
Figure 3:
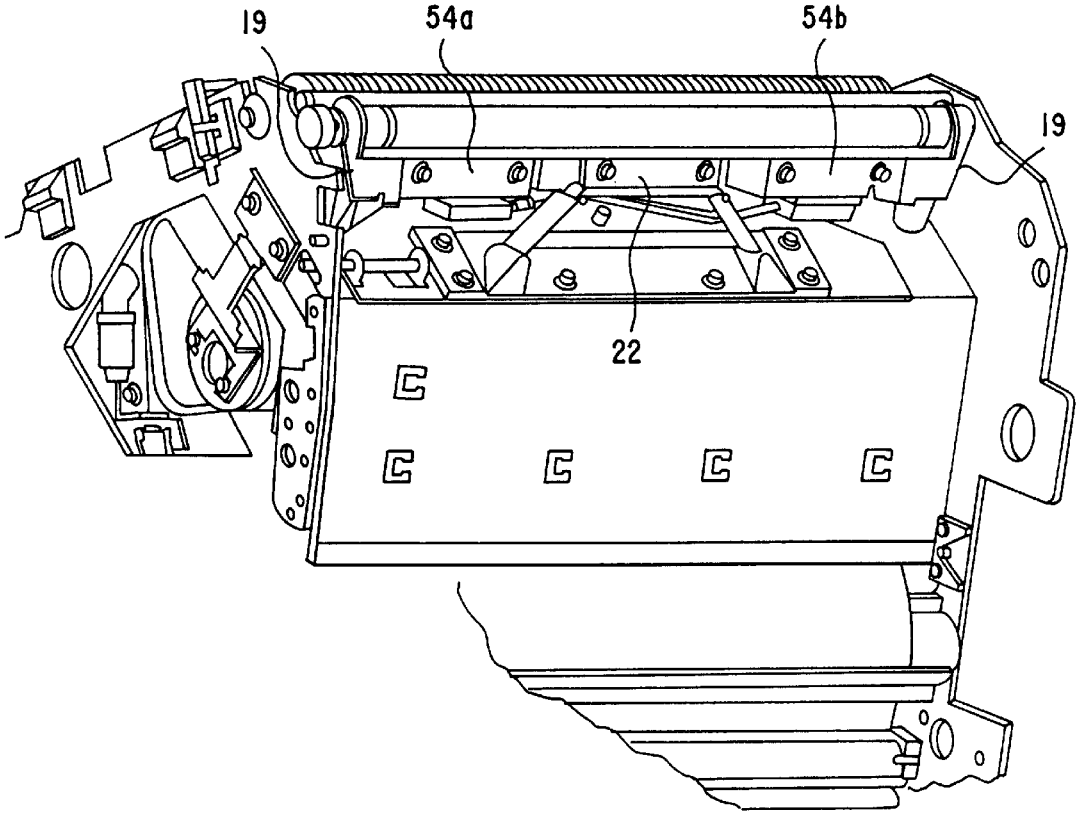
FIG. 3 is a view, in perspective, of a portion of the passive laterally constraining web support of FIG. 1, showing the mounting of a mechanism, according to this invention, for monitoring the cross-track force exerted on a movable flexible web, and using the monitored force for feedback to correct tracking of the moving web, with portions removed or broken away to facilitate viewing.
Figure 4:
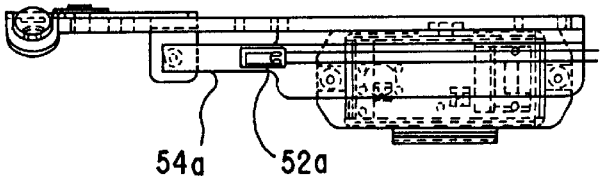
FIG. 4 is a side elevational view of the portion of the passive laterally constraining web support of FIG. 3, showing the mounting of the cross-track force monitoring and feedback mechanism, according to this invention, with portions removed or broken away to facilitate viewing.

Referring now to the accompanying drawings, FIGS. 1 and 2 show an elongated flexible web, designated generally by the numeral 10, supported for movement along a travel path, for example as an image carrying member of a reproduction apparatus. The web 10 is supported, for example, by a passive, laterally constraining web support 20 including a cylindrical roller 24 journalled in bearings 18 (e.g., needle bearings) on a shaft 25. The shaft is attached through pivot arms 27 to a pivoting bar 28, which is mounted to a fixed frame 22 through pivot 29 and is supported by anti-friction pads 30. By such arrangement, the roller 24 is able to pivot about a gimbal axis 95. Flexure members 27 are relatively thin plates designed to flex in a direction parallel to the longitudinal axis 23 in response to a lateral force, while remaining rigid in the plane of the plate. The flexure members are mounted so that their respective centerlines (lines of action 92) intersect gimbal axis 95 when the web support is in the nominal position; i.e., under no-load condition. Hence, flexure members 27 enable the roller 24 to pivot about a castering axis 90, defined by the intersection of lines of action 92, and which is perpendicular to the plane formed by such lines of action. The magnitude of castering radius 32 (see FIG. 2), which is a function of the angle A formed by the pivot arm intersecting lines of action 92, will depend on design considerations of the tracking apparatus. For example, the lateral displacement of roller 24 in response to a lateral force will be greater for a longer radius than for a shorter one, making the longer castering radius more sensitive to lateral forces.

In FIG. 2, it is seen that cylindrical roller 24 has, attached to each end, inner sleeves 17 which extend beyond the ends of the roller. Floating flanges 26 are mounted on the sleeves 17 for independent axial and rotational movement with respect to roller 24. The flanges 26 have web edge-engaging cylindrical portions 4 of the same outside diameter as roller 24. The maximum inside distance between flanges 26 is kept substantially constant by limiting wheels 21. The limiting wheels 21 are mounted for rotation on cantilevered pivot arms 19*a*, 19*b* attached to the frame 22. The peripheries of the limiting wheels 21 are in contact with the outside edges of floating flanges 26 respectively, and reduce the friction between the rotating limiting wheels and the floating flanges.

In operation, the unidirectional character of movement for the web 10 determines the orientation of the web support 20 on a web-tracking apparatus. That is, the gimbal axis 95 of the web support is substantially parallel to the plane of the entering portion of the web 10 to enable the web engaging surface of the web support to pivot about the gimbal axis without affecting the perpendicularity of the direction of travel of the entering web portion and the longitudinal axis of the roller 24 of the web support. Otherwise, due to the phenomenon of tracking, pivotal movement of the web-engaging surface about the gimbal axis would effect the upstream web portion. Similarly, the castering axis 90 intersects the plane of the entering web at an upstream location, as opposed to a downstream location. Otherwise, the web-engaging surface would become laterally unstable.

The plane of the entering portion of the web 10, moving in the direction indicated by arrow 15, is parallel to the plane formed by intersecting lines of action 92 which, for convenience, will be referred to as the entrance plane. In keeping with the web-tracking principles discussed previously, the entering portion of moving web 10 is angularly decoupled from an upstream, laterally constraining web support from which it exits to meet web support 20, without creating non-uniformity of tension in the entering portion of the web. That is, if the midpoint of the web support 20 is not in the same plane as the respective midpoints of the other web supports in the tracking apparatus, the entering portion of the web 10 must be free to change its angular direction to meet web support 20, at the angle at which it is mounted on a fixed frame, without creating nonuniformity of tension in the web span. Upon engaging the entering portion of the web 10, the roller 24 does not laterally constrain the entering web (either positionally or angularly) since the roller is free to pivot about the castering axis 90. This enables the roller 24 to align itself to the entering web so that its axis of rotation 23 is perpendicular to the direction of the entering portion of the web as indicated by arrow 15 (see FIG. 2). It is seen that the roller 24, through the phenomenon of tracking, pivots about its castering axis so that its axis of rotation 23 remains perpendicular to the direction of travel of web 10 as indicated by arrow 15.

The web support 20 includes floating flanges 26. The maximum separation of the floating flanges 26 is held constant relative to frame 22 by limiting wheels 21. This transforms the otherwise non-constraining web support into a positional constraint support which constrains the entering web against changing its lateral spatial position while remaining free to change its angular position. The inside distance between flanges 26 corresponds substantially to the width of the web 10. When the web support 20 is in its nominal position, there is an equidistant separation (designated by the numeral 5), between the ends of roller 24 and web engaging portions 4 of flanges 26. This enables lateral displacement of roller 24 due to pivotal movement about the castering axis 90. During such displacement where the separation is greater at one side, the relative positions of flanges 26 remain fixed since the flanges are mounted for axial movement on sleeves 17. It is noted that the mounting of flanges 26 on sleeves 17 enables the web engaging portions 4 to rotate with moving web 10 with nominal frictional or mechanical resistance. In essence, web-engaging portions 4 become part of roller 24.

In order to compensate for imprecise tolerances of the various components of the web support apparatus 20, it will be appreciated that for small pivotal movement of the roller 24 about castering axis 90, the lateral spatial position of the web at the roller remains fixed even though the angle of the entering web may change. The slight change in angle of the nominal position of flanges 26 from their position due to pivotal movement of roller 24 about castering axis 90 does not appreciably change the inside distance between the flanges. Hence, flanges 26 provide lateral positional stability for moving web 10. Moreover, since under nominal operating conditions the roller 24 offers substantially no lateral resistance to the entering portion of the web 10, no excess forces develop on the edges of web. Therefore, no edge damage can occur as long as the angle of the entering portion of the web is within the tolerances of the castering action of the roller 24.

Upon engagement of the entering portion of the web 10 with the roller 24, the moving web becomes fully constrained insofar as the exiting portion of the web is concerned. That is, without more, the exiting portion of the web 10 would not be free to change its angular direction; and since the lateral spatial position of moving web is fixed at roller 24, the exiting web becomes fully constrained and incapable of adjusting to downstream conditions. This situation does not affect the stability principle of web tracking. However, it does affect the uniformity of tension principle. To ensure compliance of exiting web portion 12 with this latter principle, roller 24 is mounted for pivotal movement about the gimbal axis 95.

The gimbal axis 95 is perpendicular to and intersects the longitudinal axis 23 of the roller 24 at the midpoint thereof, and lies in the entrance plane defined by the intersecting lines of action 92 of the flexure members 27 (see FIGS. 1 and 2). As noted previously, the plane of the entering portion of the web 10 is parallel to the entrance plane. Thus, the exiting portion of the web 10 is free to change its angular direction without affecting the perpendicularity of the direction of travel of moving web 10, as indicated by arrow 15, and longitudinal axis 23. This feature angularly decouples the exiting portion of the web 10 thereby enabling it to adjust to downstream conditions while promoting uniformity of tension in the exiting web. As with the castering action of roller 24, the magnitude of the movement about the gimbal axis 95 of the roller 24 is a function of the particulars of the web support apparatus 20, and should be such as to enable the exiting portion of the web 10 to change its angular direction to meet the downstream web support. Ordinarily, this magnitude does not appreciably change the inside distance between flanges 26.

As noted above, imprecise tolerances in the web support 20 (and, in fact in the web itself) may cause mistracking of the web as it travels in its path about the web support. Thus, there is a potential for damage to the edges of the web by the force of the flanges 26 on the web edges. In order to substantially prevent web edge damage, according to this invention, a simplified mechanism is provided for monitoring the cross-track force exerted on the flexible web and using the monitored force as feedback to correct tracking of the moving web. Such cross-track force monitoring and feedback mechanism is designated generally by the numeral 50, and is best shown in FIGS. 3–6. Front and rear load cells, or force transducers, 52*a*, 52*b*, are respectively mounted on beams 54*a*, 54*b*, extending from the frame 22. The beams 54*a*, 54*b* are coupled to respective pivot arms 19*a*, 19*b* to form pivot assemblies. Preferably, the load cells or force transducers are foil strain gauges. The force of the web on the flanges 26 is transmitted through the pivot arms 19*a*, 19*b* to the beams 54*a*, 54*b*. The beams will deflect in proportion to the web edge force on the flanges 26, and the resultant strain can be accurately measured by the load cells or force transducers 52*a*, 52*b*.

Figure 5:
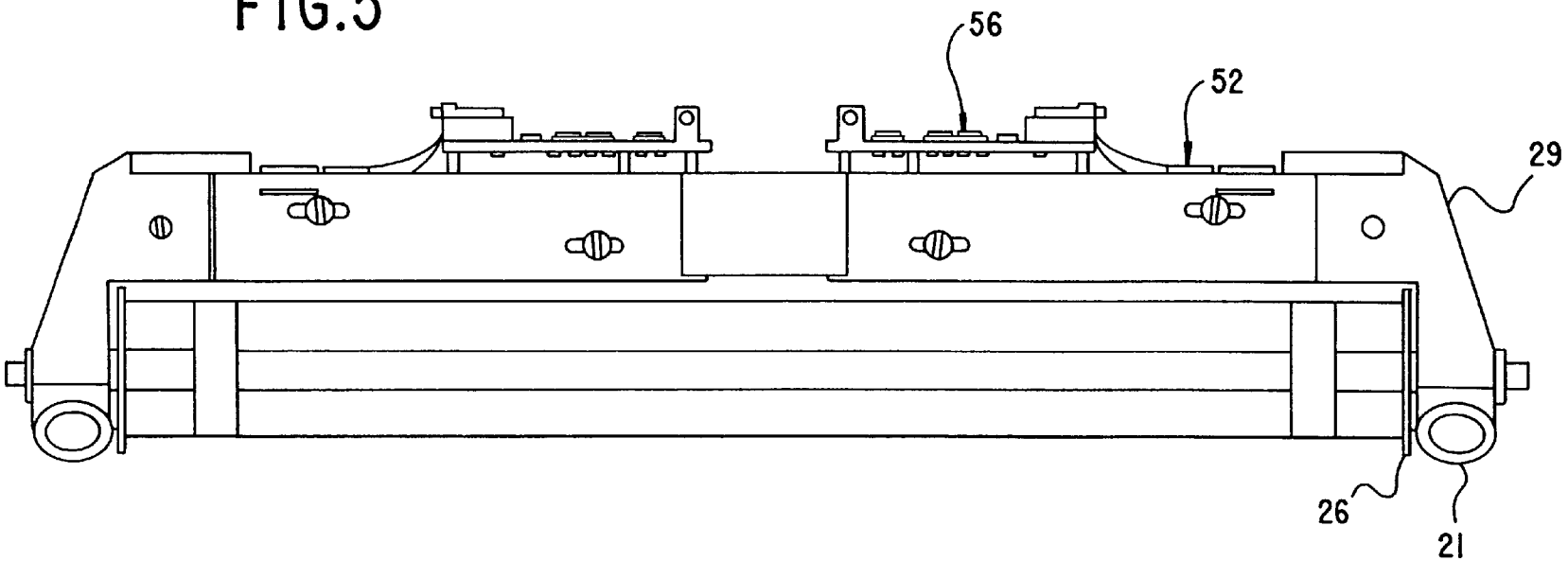
FIG. 5 is a top plan view of the cross-track force monitoring and feedback mechanism, according to this invention, with portions removed or broken away to facilitate viewing.
Figure 6:
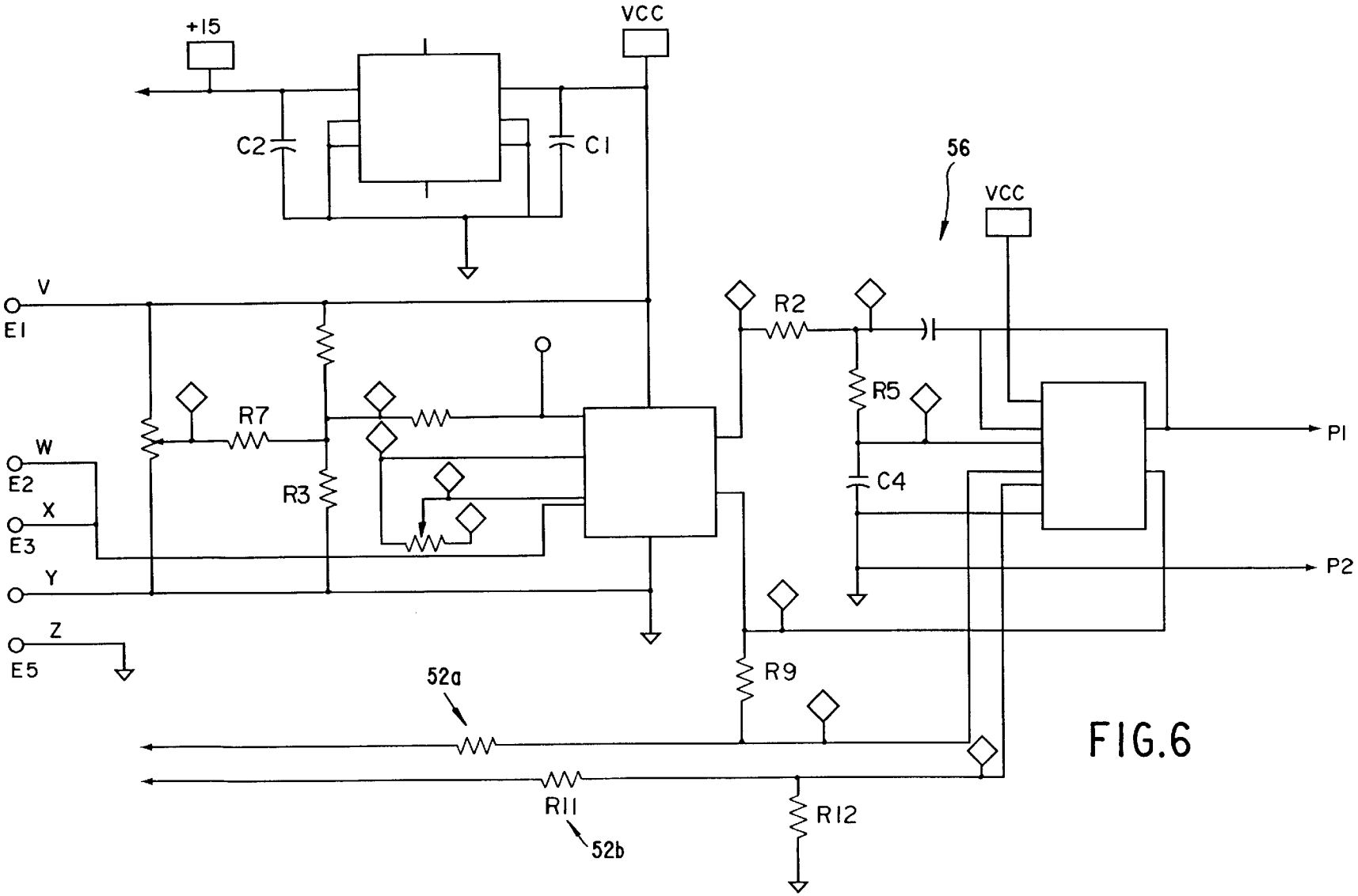
FIG. 6 is a schematic diagram of the feedback control circuit for the cross-track force monitoring and feedback mechanism according to this invention.

An output signal from the load cells or force transducers 52*a*, 52*b* is transmitted to a circuit board 56 mounted on the frame 22 (see FIG. 5). Pairs of strain gauges, when utilized as the load cells or force transducers 52*a*, 52*b*, are employed as elements in a half-bridge circuit configuration (see circuit diagram of FIG. 6) to minimize temperature and humidity effects. The strain gauges are powered from the circuit board 56. The circuit board also provides a Wheatstone bridge for balance and an amplifier for the strain gauge signal. The signal from the circuit board is provided as a feedback signal to the logic and control unit L for the web support 20 (on board or remotely located relative to the web support). Based on such feedback signal, the web support can be manually adjusted to orient the roller 24 an appropriate amount and direction about the caster axis 90 and gimbal axis 95 to relieve the forces on the web edge. Alternatively, the feedback-signal, can provide for an automatic steering correction applied a suitable drive coupled to the web support 20. Electronic sensing also enables monitoring of web-tracking performance and trends. Monitoring of the performance and trends, over time, permits the use of remote diagnostics to check tracking status and predict tracking system failures.

The invention has been described in detail with particular reference to certain preferred embodiments thereof, but it will be understood that variations and modifications can be effected within the spirit and scope of the invention.

What is claimed is:

1. A web-tracking control apparatus for controlling the movement of a flexible web traveling about an adjustable support member, said web-tracking control apparatus comprising:

at least one web edge contacting member contacting a marginal edge of said flexible web;

a pivot assembly operatively associated with said at least one web edge contacting member while said web edge contacting member is in contact with a marginal edge of said flexible web, said pivot assembly being capable of deflecting a predetermined amount proportional to the force of said flexible web on said at least one edge contacting member;

a cross-track force monitoring mechanism operatively associated with said pivot assembly, said cross-track force monitoring mechanism including a load cell or force transducer for producing a signal representative of deflection of said pivot assembly; and an electronic circuit responsive to said pivot assembly deflection signal to provide a correction signal for causing adjustment of the position of said web support member so that said web support supports said flexible web for movement without any substantially cross-track force being exerted on said at least one web edge contacting member.

2. The web-tracking control apparatus of claim 1, wherein said correction signal indicates a requirement for a determined manual adjustment to said adjustable web support member.

3. The web-tracking control apparatus of claim 1, wherein said correction signal provides for a determined automatic adjustment to said adjustable web support member.

4. The web-tracking control apparatus of claim 1, wherein said load cell or force transducer is a strain gauge.

5. The web-tracking control apparatus of claim 1, wherein said pivot assembly includes at least one flexible beam and a pivot arm connected at one end to said flexible beam and associated at the opposite end to said web edge contacting member.

6. The web-tracking control apparatus of claim 1, wherein said pivot assembly includes a pair of flexible beams and a pair of pivot arms connected respectively at one end to said flexible beams and associated at the opposite ends to a pair of web edge contacting members respectively contacting opposed marginal edges of said flexible web.

7. The web-tracking control apparatus of claim 6, wherein said cross-track force monitoring mechanism load cell or force transducer includes a pair of strain gauges respectively associated with said flexible beams.

8. The web-tracking control apparatus of claim 7 wherein, in said electronic circuit, said pair of strain gauges is arranged in a half-bridge so as to minimize effects of temperature and humidity.

9. Apparatus for controlling the movement of a flexible web traveling about a support roller mounted on a frame for adjustment about a caster axis and a gimbal axis, said movement controlling apparatus comprising:

at least one web edge contacting member contacting a marginal edge of said flexible web;

a pivot assembly operatively associated with said at least one web edge contacting member while said web edge contacting member is in contact with a marginal edge of said flexible web, said pivot assembly being capable of deflecting a predetermined amount proportional to the force of said flexible web on said at least one edge contacting member;

a cross-track force monitoring mechanism operatively associated with said pivot assembly, said at least one cross-track force monitoring mechanism being a load cell or force transducer including a strain gauge for producing a signal representative of deflection of said pivot assembly; and an electronic circuit responsive to said pivot assembly deflection signal to provide a correction signal for causing adjustment of the position of said web support roller about said caster axis and gimbal axis thereof so that said web support roller supports said flexible web for movement without any substantially cross-track force being exerted on said at least one web edge contacting member.

10. The flexible web support movement controlling apparatus of claim 9, wherein said pivot assembly includes a pair of flexible beams and a pair of pivot arms connected respectively at one end to said flexible beams and associated at the opposite ends to a pair of web edge contacting members respectively contacting opposed marginal edges of said flexible web.

11. The flexible web support movement controlling apparatus of claim 10, wherein said cross-track force monitoring mechanism load cell or force transducer includes a pair of strain gauges respectively associated with said flexible beams.

12. The flexible web support movement controlling apparatus of claim 11, wherein, in said circuit, said pair of strain gauges is arranged in a half-bridge so as to minimize effects of temperature and humidity.

* * * * *